US012398014B2

(12) United States Patent
Herrmann

(10) Patent No.: US 12,398,014 B2
(45) Date of Patent: Aug. 26, 2025

(54) MULTIDIRECTIONALLY STEPPED AUTO-COLLATOR SYSTEM AND METHOD

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 18/536,815

(22) Filed: Dec. 12, 2023

(65) Prior Publication Data

US 2025/0187865 A1 Jun. 12, 2025

(51) Int. Cl.
*B65H 39/02* (2006.01)
*B65H 39/115* (2006.01)

(52) U.S. Cl.
CPC ..... *B65H 39/115* (2013.01); *B65H 2301/433* (2013.01); *B65H 2301/43824* (2013.01); *B65H 2404/733* (2013.01)

(58) Field of Classification Search
CPC ..... B41L 43/10; B41F 13/64; B65H 39/02; B65H 39/075; B65H 39/055; B65H 39/115; B65H 2301/433; B65H 2301/435; B65H 2301/43824; B65H 2404/73; B65H 2404/733
USPC ..... 270/52.16, 52.29, 58.29
See application file for complete search history.

(56) References Cited

U.S. PATENT DOCUMENTS

| | | | | |
|---|---|---|---|---|
| 9,463,945 | B2 | 10/2016 | Herrmann | |
| 9,463,946 | B2 | 10/2016 | Herrmann | |
| 9,527,693 | B2 | 12/2016 | Herrmann | |
| 9,592,989 | B2 * | 3/2017 | Herrmann | B65H 31/3009 |
| 9,624,062 | B1 * | 4/2017 | Herrmann | B65H 31/34 |
| 10,071,877 | B2 * | 9/2018 | Herrmann | B65H 31/02 |
| 10,525,509 | B2 * | 1/2020 | Chapelet | B65G 47/46 |
| 10,968,068 | B1 | 4/2021 | Herrmann et al. | |
| 11,584,607 | B2 | 2/2023 | Ludgate et al. | |
| 12,116,156 | B2 * | 10/2024 | Herrmann | B65H 31/36 |
| 2016/0185557 | A1 | 6/2016 | Herrmann | |
| 2017/0129733 | A1 | 5/2017 | Herrmann | |

* cited by examiner

*Primary Examiner* — Leslie A Nicholson, III
(74) *Attorney, Agent, or Firm* — Caesar Rivise, PC

(57) ABSTRACT

An automated media sheet processing system for automated collating, stacking and transferring media sheets exiting a media source includes a dynamically oriented baffle having a plurality of stepped bins. Each stepped bin is slidingly arranged adjacent another stepped bin, with the stepped bins configured to receive media sheets and allow them to fall onto and accumulate on the stepped bins. The stepped bins may move and change orientation into a stair configuration descending in different directions. An automated reciprocating pusher may move in the different directions orthogonally to the stepped bins to move and collate the media sheets into collated stacks downstream the stepped bins on different or opposite sides of the dynamically oriented baffle, with no reset or extraneous movement needed between reciprocating pushes. No reset is needed because the reciprocating pusher ends a first push in position to start a next push to the opposite side.

20 Claims, 11 Drawing Sheets

MULTIDIRECTIONALLY STEPPED AUTO-COLLATOR SYSTEM AND METHOD

FIELD OF DISCLOSURE

This invention relates generally to an automated collation system, and more particularly, to a reversing stepped auto-collation system that automatically collects and collates retail signage destined for in-store shelves.

BACKGROUND

Retail stores often utilize signage (e.g., edge markers) to convey information regarding products offered for sale, e.g., product costs, unit cost, sale pricing, etc. Such markers must be updated and/or replaced on a periodic basis. For example, regular product pricing may change, or during a sale, a discounted price may be necessary. Changes to edge markers may be required for hundreds or even thousands of products and these changes may be required daily weekly or another periodic term. In addition, product placement may change which would require updating of the edge markers. In some states, it is critical that the edge markers be updated in a timely fashion as the retail store may be obligated to honor the price displayed adjacent the product. In other words, if the store fails to remove the edge marker that displays a discounted cost, the store must charge that cost if a customer relies upon that price when making a purchase selection. In view of the foregoing, it should be apparent that proper timing and placement of edge markers is a critical responsibility of a retail store.

Although some retail chain stores share common store layouts, also known as a store planogram, most retail locations, even within a chain store have unique store planograms. The changeover of store signage can incur significant time which in turn incurs significant cost. A common practice is to print sheets of edge marker strips and an employee or group of employees are tasked with edge marker changeover. These methods include various deficiencies, e.g. edge marker strips compiled out of order or not matched to the store planogram, sheets that require further separation of individual store departments, etc. These methods are quite costly and presently, in at least one instance, requires for example, 20 people employed to individually catch and collate each sheet of edge markers. Other media collating systems including U.S. Pat. Nos. 9,463,945 B2, 9,463,946 B2 and 9,527,693 B2, are known, but the heretofore-mentioned problems persist.

Obviously, there is a need for a more efficient shelf edge marker collation system that presents shelf edge markers to store employees in a per store planogram order for in-store deployment. U.S. Pat. No. 10,968,068 B1 discloses such a system. Still it would be more beneficial to provide an automated solution for collating and processing the edge marker strips with greater efficiencies for subsequent shipping to a store.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a media sheet processing apparatus for automatically collating and transferring media sheets exiting an upstream source. The media sheet processing apparatus includes a dynamically oriented baffle and an automated reciprocating pusher. The dynamically oriented baffle has a plurality of stepped bins, each stepped bin slidingly arranged adjacent another one of the plurality of stepped bins and having a longitudinal surface to receive a first set of the media sheets deposited thereon. The dynamically oriented baffle is configured to first shift the plurality of stepped bins vertically and change height with respect to an adjacent stepped bin, the first shift of the stepped bins resulting in the plurality of stepped bins having a first stair configuration descending in a first direction. The automated reciprocating pusher is configured for automatic bidirectional movement in a cross process direction to the deposited media sheets. Further, the automated reciprocating pusher is configured during a first operation to move the first set of media sheets in the first direction from the stepped bins in the first stair configuration into a first compiled collated stack at a first position, and during a second operation to move an additional set of media sheets in a second direction opposite the first direction. The dynamically oriented baffle is further configured to dynamically second shift the stepped bins vertically and change vertical orientation with respect to the adjacent stepped bin, with the second shift of the stepped bins resulting in the plurality of stepped bins having a second stair configuration descending in the second direction.

According to aspects illustrated herein, an exemplary media sheet processing method for automatically collating and transferring media sheets exiting an upstream source includes providing a dynamically oriented baffle having a plurality of stepped bins, each stepped bin slidingly arranged adjacent another one of the plurality of stepped bins and having a longitudinal surface to receive media sheets deposited thereon, the dynamically oriented baffle configured to first shift the plurality of stepped bins vertically and change height with respect to an adjacent stepped bin, the first shift of the stepped bins resulting in the plurality of stepped bins having a first stair configuration descending in a first direction; receiving a first set of the media sheets from the upstream source onto the longitudinal surfaces of the plurality of stepped bins; providing an automated reciprocating pusher configured for automatic bidirectional movement in a cross process direction to the deposited media sheets; during a first operation, moving the automated reciprocating pusher in a first direction to move the first set of the media sheets from the stepped bins in the first stair configuration into a first compiled collated stack at a first position; and dynamically shifting the stepped bins vertically and into a different vertical orientation with respect to the adjacent stepped bin resulting in the plurality of stepped bins having a second stair configuration descending in a second direction opposite the first direction, the plurality of stepped bins further configured to receive a second set of media sheets deposited thereon. The method may also include, during a second operation, moving the automated reciprocating pusher in a second direction opposite the first direction to move the media sheets from the stepped bins in the second stair configuration into a second compiled collated stack at a second position distanced from the first position.

According to aspects described herein, an exemplary media sheet processing system for automatically collating and transferring media sheets exiting an upstream source includes a dynamically oriented baffle, a compiler, and an automated reciprocating pusher. The dynamically oriented baffle has a plurality of stepped bins, each stepped bin slidingly arranged adjacent another one of the plurality of stepped bins and having a longitudinal surface to receive a first set of the media sheets deposited thereon. The dynamically oriented baffle is configured to first shift the plurality of stepped bins vertically and change height with respect to an adjacent stepped bin, the first shift of the stepped bins resulting in the plurality of stepped bins having a first stair configuration descending in a first direction. The compiler is positioned along the processing path between the upstream source and the dynamically oriented baffle, with the compiler being operatively connected to the dynamically oriented baffle. The compiler is configured to receive the media sheets exiting the upstream source and to temporarily hold the media sheets, and following one of the first operation and the second operation, the compiler is further configured to release the held media sheets to the dynamically oriented baffle. The automated reciprocating pusher is configured for automatic bidirectional movement in a cross process direction to the deposited media sheets, wherein, in response to detecting that the first set of the media sheets have settled into the bins for collation thereof, the automated reciprocating pusher is configured during a first operation to move the first set of the media sheets in the first direction from the stepped bins in the first stair configuration into a first compiled collated stack at a first position.

The dynamically oriented baffle is further configured to dynamically second shift the stepped bins vertically and change vertical orientation with respect to the adjacent stepped bin, the second shift of the stepped bins resulting in the plurality of stepped bins having a second stair configuration descending in a second direction opposite the first direction. The longitudinal surfaces of the stepped bins are further configured to receive a second set of the media sheets deposited thereon. In response to detecting that a second set of media sheets have settled into the bins for collation thereof, the automated reciprocating pusher is further configured during a second operation to move the second set of the media sheets in the second direction from the stepped bins in the second stair configuration into a second compiled collated stack at a second position distanced from the first position. The automated reciprocating pusher is further configured to move bidirectionally horizontally in the first direction and second direction without vertical movement therebetween.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
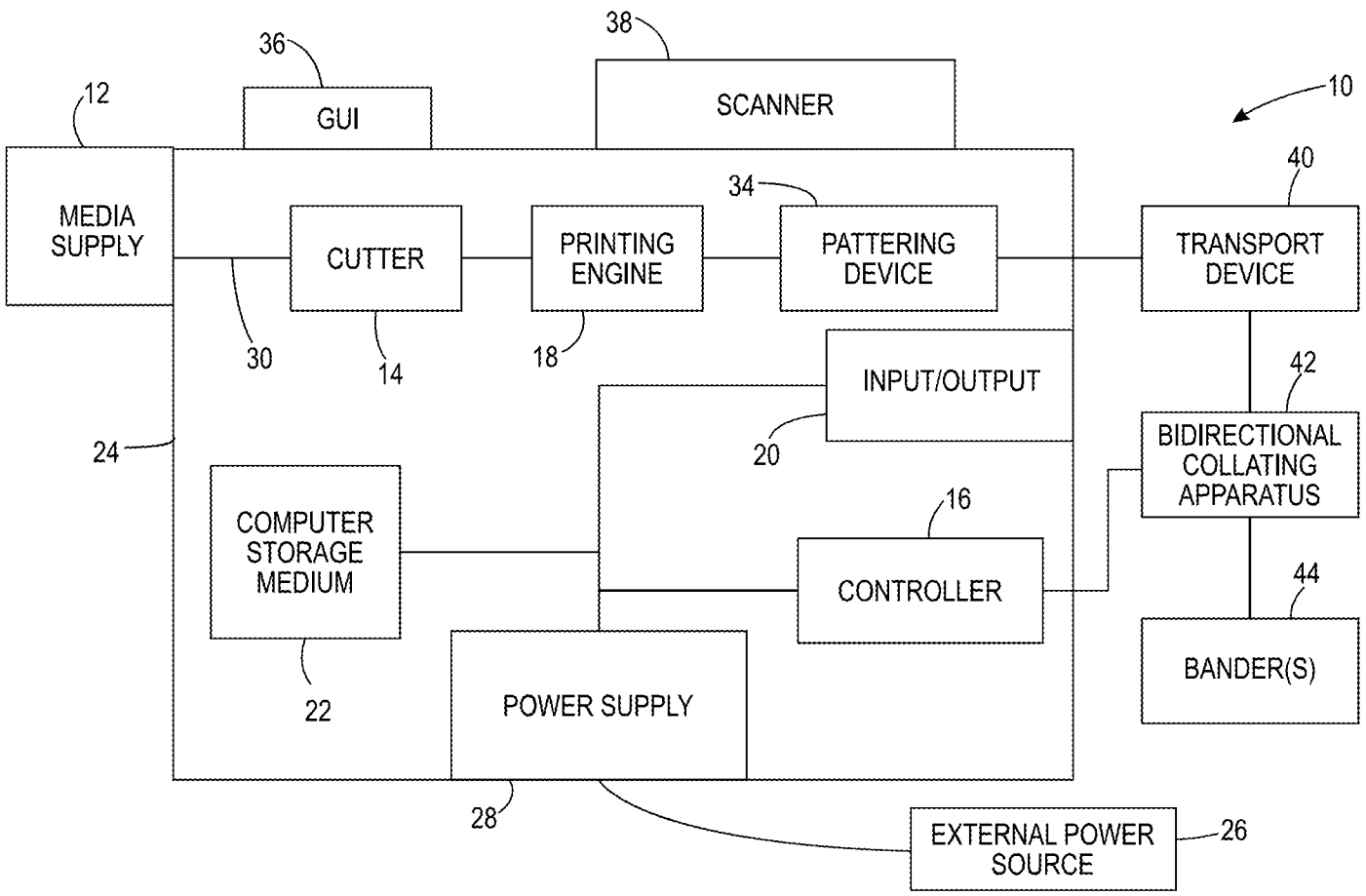
FIG. 1 is a schematic diagram of an exemplary media sheet processing system according to systems, apparatuses and methods herein.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatuses, and systems for automatically collecting, collating and transporting media sheets (e.g., workpieces, retail edge marker strips) destined for in-store shelves.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

Although embodiments of the invention are not limited in this regard, discussions utilizing terms such as, for example, "processing," "computing," "calculating," "determining," "using," "establishing", "analyzing", "checking", or the like, may refer to operation(s) and/or process(es) of a controller, computer, computing platform, computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Figure 3:
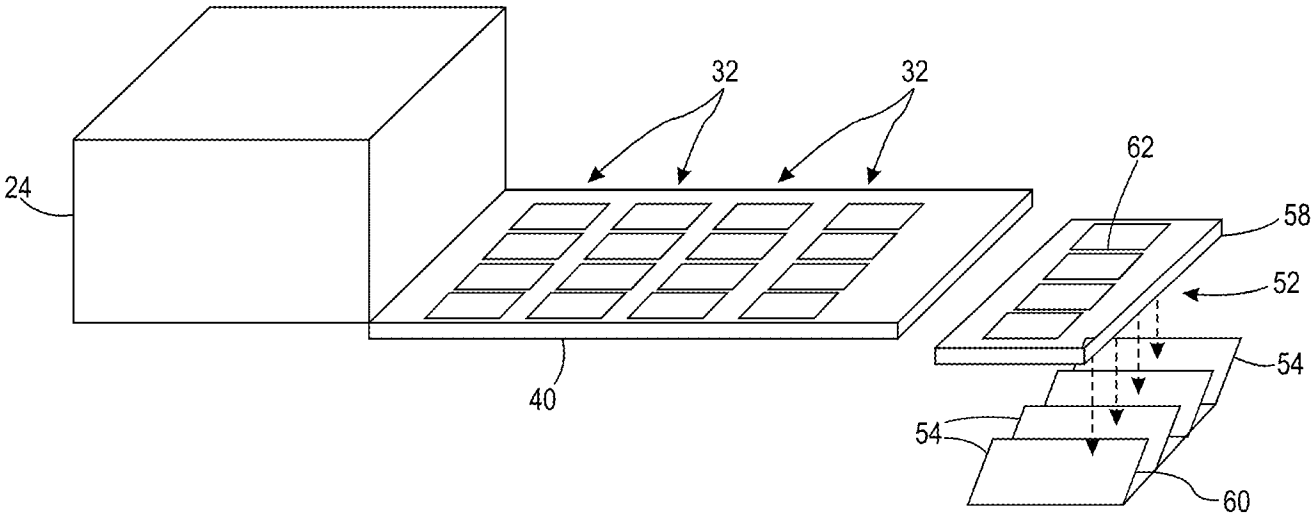
FIG. 3 is a perspective view schematic diagram of a related art media sheet processing apparatus.

Referring now to the drawings, and more specifically to FIG. 1, what is illustrated is an exemplary automated media sheet processing system 10, which can be used with methods herein. The system 10 is an example of a multidirectionally stepped auto-collator system that may automatically collate and transfer media sheets exiting an upstream source 50 (FIG. 3). The upstream source 50 may include a media supply 12, such as a conventional unwinder that roll feeds media sheets in continuous sheet form into a conventional cutter 14 that cuts the continuous roll fed sheet media sheets into predetermined lengths of, e.g., about 5 inches to 8 feet, or about 8 inches to 2 feet, or about 13-14 inches. In examples, each predetermined sheet length may be cut into four separate and individual workpieces (e.g., media sheets 32 (FIG. 3)) and each workpiece may be perforated into a number (e.g., four) of parallel sections to accommodate different in-store requirements. It is understood that the predetermined sheet lengths may be cut into other numbers of separate and individual workpieces, and that each individual workpiece may be perforated into other numbers of different parallel sections. While this upstream source 50 feeds roll stock and cuts and perforates the stock, it does not include a system for automatically accumulating and collating media sheets 32 exiting the upstream source.

The system 10 includes a controller 16 and at least one marking device (printing engine(s)) 18 operatively connected to the controller. The system may also include a communications port (Input/Output device 20) operatively connected to the controller 16 and to a computerized network external to the system 10. The Input/Output device 20 may be used for communications to and from the system 10, as well understood by a skilled artisan.

The controller 16 includes at least one processor and controls the various actions of the system 10, as described in greater detail below. A storage medium 22 (e.g., non-transitory computer storage medium, which may be optical, magnetic, capacitor based, etc.) is readable by the controller 16 and stores instructions that the controller 16 executes to allow the system 10 to perform its various functions, such as those described herein. Thus, as shown in FIG. 1, a body housing 24 has one or more functional components that operate on power supplied from an external power source 26, which may comprise an alternating current (AC) power source, through a power supply 28. The power supply 28 may include a power storage element (e.g., a battery) and connects to the external power source 26. The power supply 28 converts the power from the external power source 26 into the type of power needed by the various components of the system 10.

The system 10 has the media supply 12 providing media to a media path 30. The media path 30 may include any combination of belts, rollers, nips, drive wheels, vacuum devices, air devices, etc. that transport the media from the media supply 12 through system 10, as well understood by a skilled artisan. The system 10 includes a marking device (e.g., printing engine 18) positioned along the media path 30. The marking device prints marks on the media. Further, the cutter 14 may be positioned along the media path 30, and the cutter divides (cuts) the media into individual workpieces or media sheets 32 (FIG. 3), such as signs.

While signs are used as an example of a type of media sheet that can be processed with the system 10 herein, those ordinarily skilled in the art understand that virtually any form of workpiece that can be stacked could be used with the disclosed structures and methods, and the claims are not limited only to signs. Therefore, signs, sheets of paper, cards, pieces of plastic, etc., as well as many other items could be the media sheets processed by the systems and methods herein.

A patterning device 34 may be positioned along the media path 30. The patterning device 34 may include cutters in addition to the cutter 14 to further cut the media sheets into smaller media sheets (e.g., orthogonally to the first direction slit of the cutter 13), such that each further cut media sheet may correspond to an individual sign. The patterning device 34 may also insert additional patterns into the media sheets 32, such as perforations. The cutter 14 and the patterning device 34 may be combined into a single device or can be separate devices, depending upon the specific configuration. Further, the printing engine 18, cutter 14, and patterning device 34 may be positioned in any order along the media path 30, and the order shown is purely arbitrary.

While not being limited to a particular configuration, system 10 may include at least one accessory functional component, such as a graphic user interface (GUI) assembly 36, an optical scanner 38, or other accessory functional component (such as a document handler, automatic document feeder (ADF), etc.) that operate on power supplied from the external power source 26 via the power supply 28.

A transport device 40 is additionally positioned along the media path 30. The transport device 40 moves the media sheets 32 from the media path 128 and places the media sheets into a bidirectional collating apparatus 42, as will be described in greater detail below. After the media sheets 32 are compiled and collated, the collated media sheets may be forwarded to additional stations, such as at least one bander 44, for further processing and distribution as desired.

As would be understood by those ordinarily skilled in the art, the system 10 shown in FIG. 1 is only one example and the systems and methods herein are equally applicable to other types of devices that may include fewer components or more components. For example, while a limited number of printing engines and media paths are illustrated in FIG. 1, those ordinarily skilled in the art would understand that many more media paths and additional printing engines may be included within any device used with embodiments herein.

Figure 2:
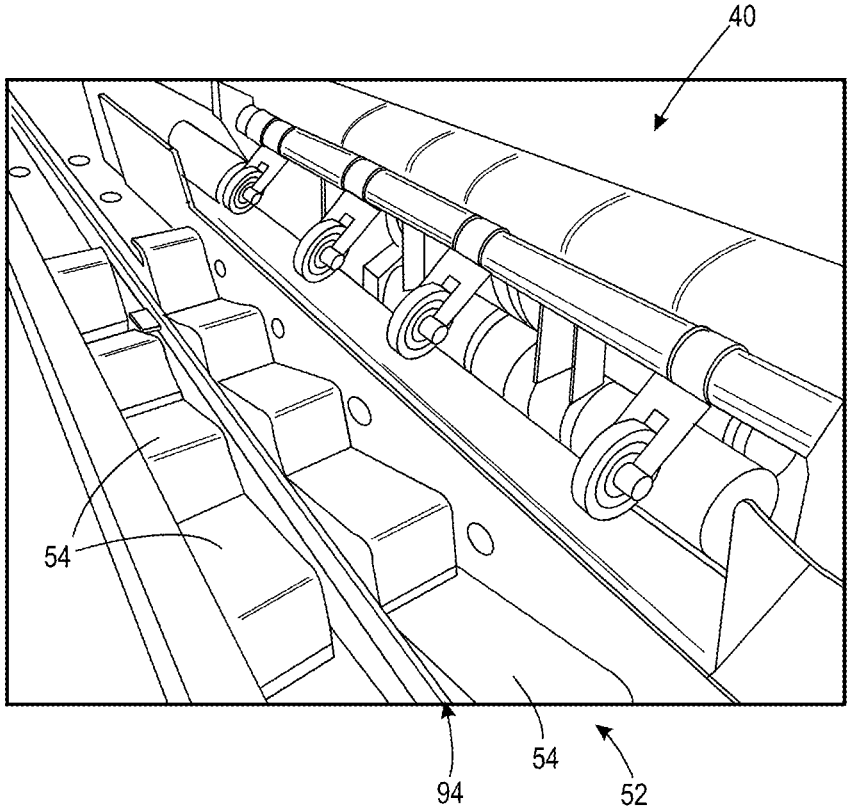
FIG. 2 is a partial perspective view of a related art media sheet processing apparatus media path.
Figure 4:
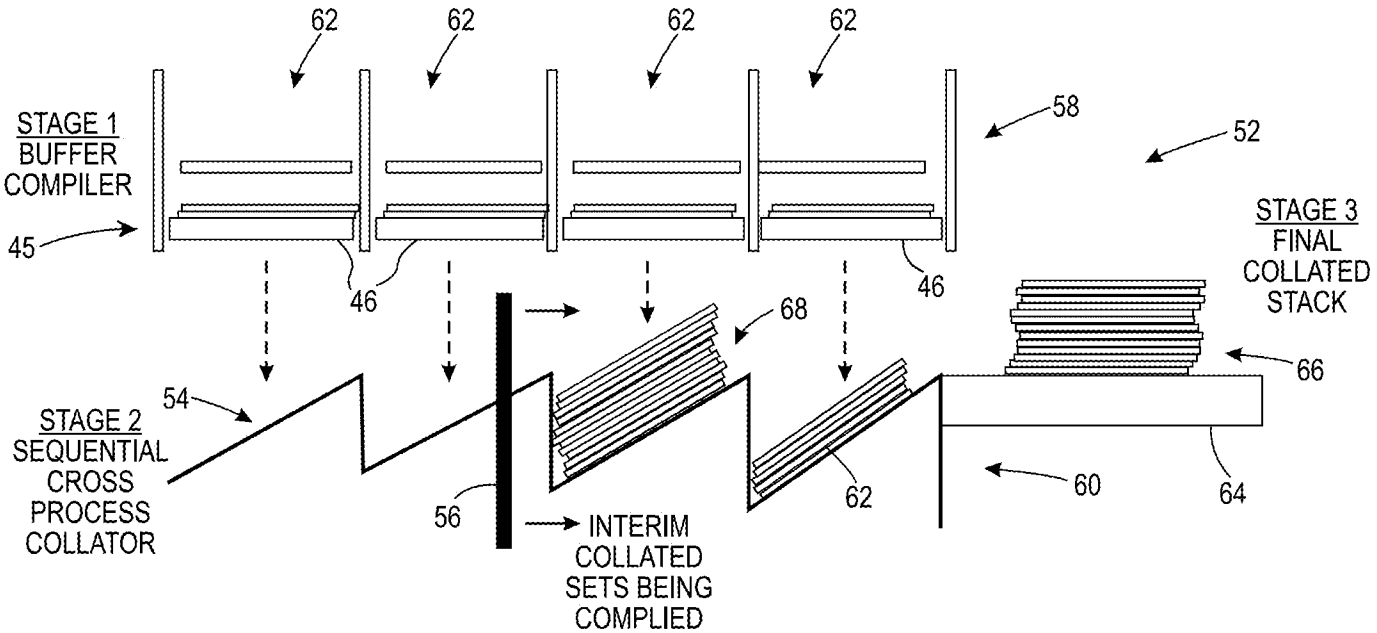
FIG. 4 is a side view of a related art stacking/collating device showing a series of angled baffles.

FIGS. 2 and 3 depict related art media sheet processing apparatus media path sections including an accumulation and collating device 52 located directly after a transport device 40. FIG. 4 depicts a related art accumulation and collating device 52 in side view. The accumulation and collating device 52 includes a series of ramped angled baffles 54 that accept and register media sheets 32 exiting the transport device 40 and accumulates the registered media sheets. Each angled baffle 54 is configured to allow the media sheets 32 to fall into place during an accumulation stage and then allow the media sheets to be collated into a compiled stack after all of the media sheets have been fed from transport device 40. The angled baffles 54 may also have an aperture 94 that splits the baffles 54 into separate sections to permit transverse movement by a pusher 56, as will be described in greater detail below.

As may be seen in FIGS. 3 and 4, the transport device 40 moves media sheets 32 to the related art accumulation and collating device 52. The accumulation and collating device 52 may include a buffer/compiler 58 above a sequential cross-process collator 60 having the angled baffles 54. The buffer/compiler 58 holds one or more media sheets 32 in stacks 62 above the collator 60 to allow time for the collator to actuate and reset before the next stack 62 of media sheets 32 are collated. In examples, the buffer/compiler 58 includes shelves 46 that support the stacks 62 above respective angled baffles 54. The buffer/compiler may also include walls 48 between shelves 46 to help segregate the media sheets 32 into separate stacks 62 on the shelves.

The compiling and collating process may be divided into stages. In a first stage, the media sheets 32 are output from the body housing 24 into the buffer/compiler 58 where they are compiled in stacks 62 on the shelves 46. The media sheets 32 in the stacks 62 are in a predetermined sequential order as controlled by the controller 16. In a second stage, also referred to as an accumulation state, the stacks 62 are dropped onto the angle baffles 54 of the collator 60. The stacks 62 may be dropped from the shelves 46 in various ways. For example, the shelves 46 may be moveable and configured to slide out to a first position to support media sheets 32 output from the body housing 24, and also to retract or otherwise move to a second position that allows the stacked media sheets to fall or move onto the angled baffles 54. In other examples the stacks 62 may be urged or pushed out of the shelves 46 onto the angled baffles.

The collator 60 includes the series (e.g., more than one) of the ramped angle baffles 54 and an automated pusher 56 (FIG. 4) that moves each of the stacks 62 toward a final collated stack 66. At the end of the accumulation stage, the pusher 56 is moved orthogonally to the media sheets 32 to push the media sheets from each ramped angled baffle 54 onto the top of media sheets in adjacent bins of baffles 54 in succession to collate the media sheets onto a final stack platform 64 (FIG. 4). That is, during this stage, which may be considered a third stage, the pusher 64 sweeps the stacks 62 in sequential order as an interim stack 68. Continued sweeping of the pusher across the baffles 54 to the final stack platform 64, results in the interim stack 68 of collated media sheets 32 pushed onto the final stack platform as the final collated stack 66. The final collated stack 66 has a predetermined number of media sheets 32 in a known order as controlled by the controller 16. Pusher 56 may be arranged for automated pulling through openings 70 (FIG. 2) between baffles 54 towards platform 64 to unload the dropped media sheet stacks 62 from each baffle and simultaneously convey the interim stack 68 onto the platform at a stacking position thereon laterally across from the angled baffles as a collated stack 66 after all of the predetermined number of media sheets 32 have been fed from the transport device 40.

The multi-stage process allows the transport device 40 to stack the media sheets 32 in the buffer/compiler 58 for temporary holding in order to provide the time needed for previous sets of media sheets to be collated underneath. This allows the pusher 56 time to move the interim stacks 68 into a final collated stack 66 and to return to a starting (e.g., home) position prior to the buffer/compiler 58 releasing its temporary hold of the stacks 62 and dropping the next stacks down into the collator 60.

The related auto-collation apparatus discussed above thus employs a set of static angled collation baffles and a one-directional push to a single final stack platform 64. This automated apparatus makes use of a right angle accumulation and collating device 52 which is used to compile and then sweep the stacks 62 of media sheets in only one direction with the pusher 56. After each push of a collation the accumulation and collating device 52 resets by rewinding the pusher position to home to prepare for the next collation. Because the accumulation and collating device 52 must reset to the home position the time associated with the reset must be accommodated for in the apparatus timing. This adds significant time to the overall process. In other related systems, after each push of the pusher 56 for a collation, the accumulation and collating device 52 resets by lowering the pusher below the static angled collation baffles 54 so the pusher can traverse below the angled baffle and collating media sheets during the retract move. Then the accumulation and collating device 52 raises the pusher 56 after the traversal. However, this drop and reset to height causes additional vibration and settling issues. Even after the pusher 56 completes its traversal and reaches its home position, it is actuated into the up/push position where it must wait to settle prior to commencing the next push.

Exemplary embodiments replace the fixed collation angled baffled bins, one-direction push and reset motion of related systems with a collating system of dynamic stepped bins that change height and include a bi-directional push with no reset. As discussed in greater detail below, the collating system includes the bidirectional collating apparatus 42 that overcomes any need for the above-discussed reset by collating and pushing alternatively in opposing directions, thereby reducing the time needed for continuous collation of media sheets. In examples, the collating system counts the sheets for a collation, and pushes completed sets to a corresponding bander. Once the pusher and completed sets have cleared the bins, the dynamic stepped bins move and change orientation into a stair configuration descending in a different direction, and a next collation may be collected. While not being limited to a particular theory, a second bander may be added adjacent the collation system at a location opposite or offset from the first bander so there may be a bander on different sides of the collation system. Once collected, a next completed set may be pushed to another bander. In this way the collation system may alternately push completed sets to each bander eliminating the need for a reset motion and associated timing loss. No reset is needed because the pusher ends a first push in position for the start of a next push to the opposite side/bander.

Figure 5:
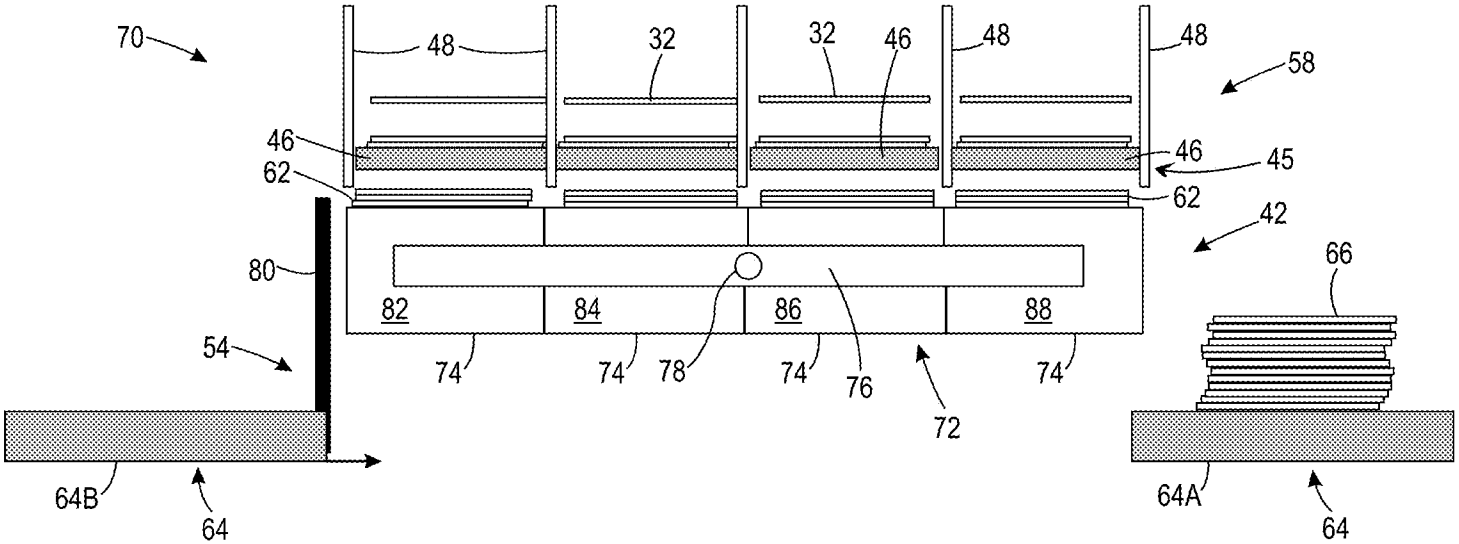
FIG. 5 is a side view of a collating system in accordance with examples of the embodiments.

FIG. 5 depicts an exemplary collating system 70 in accordance with exemplary embodiments. The collating system 70 includes the bidirectional collating apparatus 42 and may include the buffer/compiler 58 upstream the bidirectional collating apparatus and after the body housing 24. The bidirectional collating apparatus 42 includes a dynamically oriented baffle 72 having a plurality of dynamically stepped bins 74 (e.g., shelfs, blocks, supports, escalator platforms, stairway steps) identified individually as stepped bins 82, 84, 86, 88, with each stepped bin arranged adjacent to another one of the stepped bins. The stepped bins 74 each have a top surface sized and shaped to receive and support a stack 62 of media sheet 32 thereon. In examples the top surface may be at least substantially flat and horizontal to help prevent deposited media sheets 32 from unintentionally sliding off the top surface.

Each bin 74 may be configured to shift or slide dynamically relative to an adjacent bin, and to maintain its top surface horizontal orientation throughout the dynamic movement. Bins 74 may be sliding arranged next to an adjacent bin, for example, with each bin coupled to at least one lever 76 or other supporting member configured to dynamically support the bins throughout their shifting movements. The lever 76 may be a rigid rod or board pivotably attached to a fixed fulcrum 78 (e.g. rod, stem) to rotate around the fulcrum. In examples, stepped bins 74 may be attached to the lever 76 via a respective pin (not shown) extending out of each stepped bin into a longitudinal slot or channel (not shown) extending longitudinally within the lever and facing the bin. As the lever 76 pivots, the pins may slide within the lever channel to allow the dynamic stepped bins 74 to move vertically with respect to its adjacent bin(s) while maintaining its top surface orientation, as readily understood by a skilled artisan.

Still referring to FIG. 5, the bidirectional collating apparatus 42 includes an automated bidirectional pusher 80 similar to the automated pusher 56. However, unlike the pusher 56, the bidirectional pusher 80 is configured to push stacks 62 of media sheets 32 in multiple directions onto different platforms 64 located at opposite sides of the dynamically oriented baffle 72. In examples, the bidirectional pusher 80 may include a substantially vertically extending bar (e.g., rod, pole, stem, shaft, support beam, handle) configured to sweep back and forth across the dynamically oriented baffle 72 without a need to rewind or reset to a home position between successive pushes. The bidirectional pusher 80 is thus an exemplary automated reciprocating pusher configured for automatic bidirectional movement in a cross process direction to the media sheets 32 deposited onto the dynamically stepped bins 74.

The bidirectional pusher 80 is shown at a first position in FIG. 5 left of the dynamically stepped bins 74, which are shown in a neutral horizontal configuration with the stepped bins next to each other. This neutral horizontal configuration may be part of a buffer collection configuration where the bins 74 are oriented to receive stacks 62 of media sheets. Of course the buffer collection configuration is not limited to the neutral horizontal configuration and includes additional stepped bin orientations that allow deposition of media sheets onto the stepped bins in neutral, ascending or descending configurations. A stack 62 of media sheets 32 is shown deposited on each stepped bin 74 from the buffer/compiler 58. Meanwhile, additional media sheets 32 are shown deposited on the buffer/compiler shelves 46 that may be subsequently deposited on the stepped bins 74.

Figure 6:
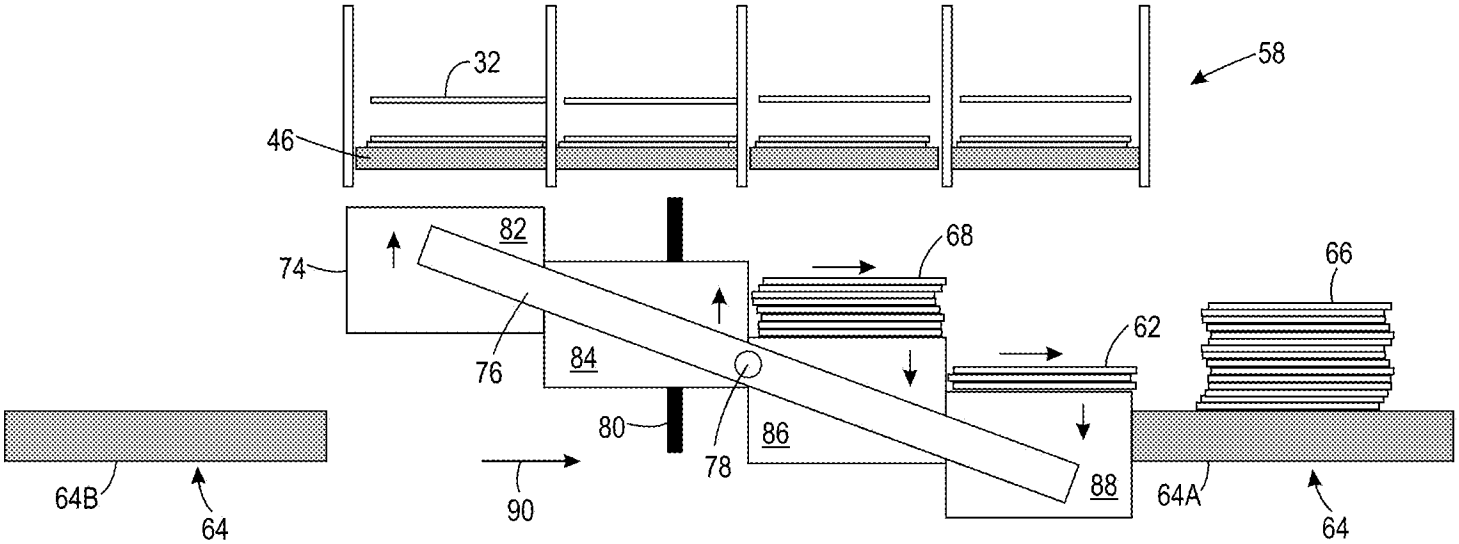
FIG. 6 is a side view of the collating system of FIG. 5 according to systems and methods herein.

FIG. 6 depicts the collating system 70 of FIG. 5 with the stepped bins 74 having a first stair configuration descending in a first direction 90 downhill from left to right in the view. While not being limited to a particular configuration, during a dynamic movement or shift, each stepped bin 74 may move vertically and change height with respect to an adjacent stepped bin. As can be seen in the stage shown in FIG. 6, the lever 76 may be pivoted clockwise from the lever shown in FIG. 5. This clockwise pivot shifts the stepped bins 74 left of the fulcrum 78 vertically upwards, with stepped bin 82 shifted higher relative to stepped bin 84 due to its greater distance from the fulcrum. Similarly, the clockwise lever 76 pivot shifts the stepped bins 74 that are right of the fulcrum 78 vertically downwards, with stepped bin 88 shifted lower relative to stepped bin 86 due to its greater distance from the fulcrum. The clockwise pivot results in the stepped bins 74 having a first stair configuration descending in the first direction 90, and the top surface maintains its horizontal orientation throughout the pivot.

After the lever 76 completes its clockwise pivot, or at least pivots sufficiently for the top surface of a higher stepped bin 74 to be above a height of the stack 62 in the adjacent next lower stepped bin, a first sweeping operation of the automated bidirectional pusher 80 may commence. During this first sweeping operation, the bidirectional pusher 80 sweeps the stacks 62 in sequential order along the first direction 90 onto an interim stack 68 and towards a final collated stack 66 on the right-side platform 64*a*. The final collated stack 66 is formed by the automated bidirectional pusher 80 moving via a pusher drive system (not shown) that may include at least one motor (e.g., servo motor, stepper motor) that drives the bidirectional pusher back and forth across the stepped bins 74 in one of the cross process directions to stack the separate stacks 62 into a single collated stack that may be arranged in in-store planogram order, as understood by a skilled artisan.

It should be noted that the collated stack 66 shown in FIGS. 5 and 6 may be moved from the right-side platform 64*a* before the interim stack 68 and stacks 62 are moved to the right-side platform for further processing. Such further processing may include forwarding the collated stack 66, for example via a rotating conveyor belt, from the right-side platform 64*a* to a bander 44*a* to secure the collate stack together. Similar to the ramped angled baffles 54 shown by example in FIG. 2, the stepped bins 74 may include an aperture 94 that splits each stepped bin into a front section 92 visible in the views of FIGS. 5-8 and a back section. In examples, the bidirectional pusher 80 may sweep across the dynamically oriented baffle 72 by traversing across the aperture within the stepped bins, as readily understood by a skilled artisan.

Figure 7:
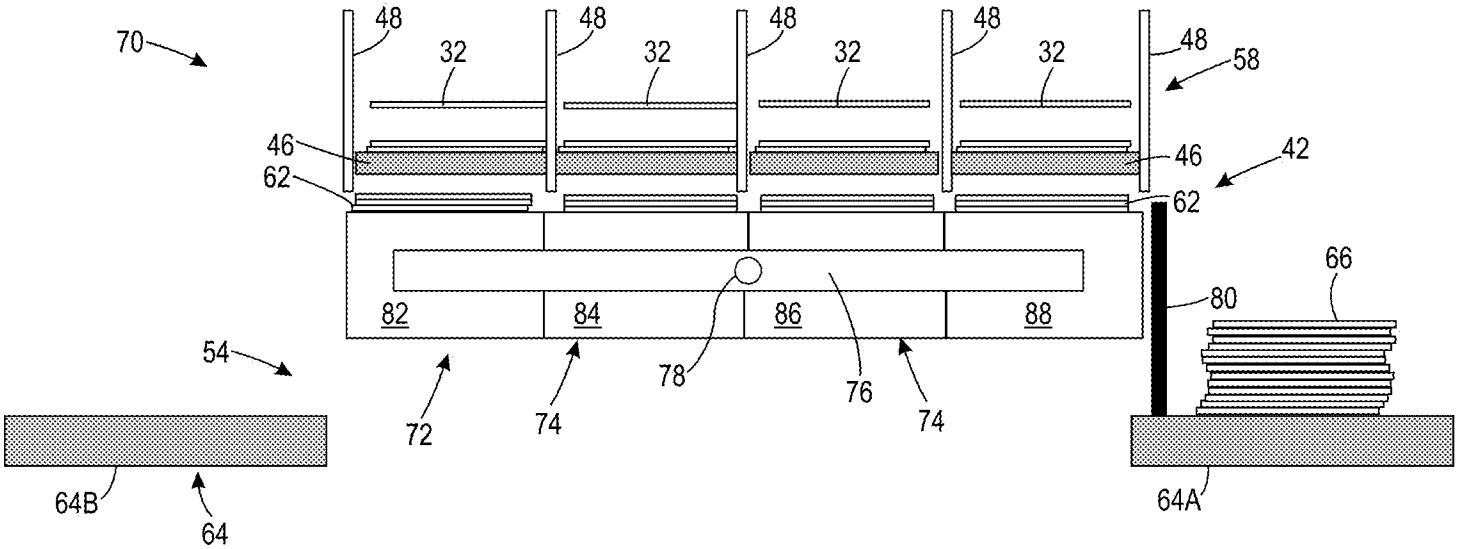
FIG. 7 is a side view of the collating system of FIG. 5 according to systems and methods herein.

FIG. 7 depicts the collating system 70 of FIG. 5 with the stepped bins 74 back in their neutral horizontal configuration, with the automated bidirectional pusher 80 at a second position right of the dynamically stepped bins 74, and with the collated stack 66 formed by the left-to-right sweep of the bidirectional pusher 80 on the right-side platform 64*a*. In examples where FIG. 7 sequentially follows FIG. 6, the lever 76 may be pivoted counterclockwise from the lever shown in FIG. 6. This counterclockwise pivot shifts the stepped bins 74 left of the fulcrum 78 vertically downwards, and shifts the stepped bins 74 that are right of the fulcrum 78 vertically upwards, resulting in the stepped bins 74 shifted back to their neutral horizontal configuration, and the top surface maintaining its horizontal orientation throughout the pivot.

Figure 8:
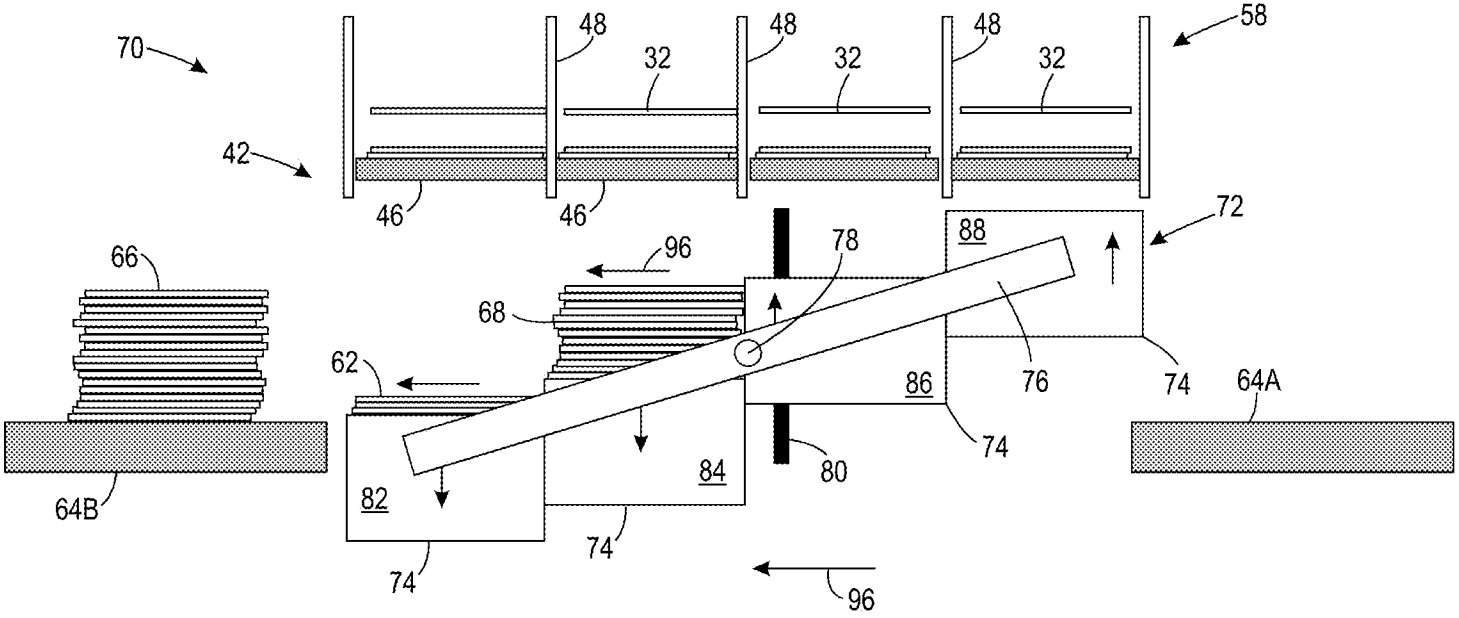
FIG. 8 is a side view of the collating system of FIG. 5 according to systems and methods herein.

FIG. 8 depicts the collating system 70 of FIG. 5 with the stepped bins 74 having a second stair configuration ascending in the first direction 90 uphill from left to right in the view. In examples where FIG. 8 sequentially follows FIG. 7, the lever 76 counterclockwise pivot continues from the lever shown in FIG. 6. Each stepped bin 74 continues vertical movement and changes height with respect to an adjacent stepped bin. This counterclockwise rotation shifts the stepped bins 74 left of the fulcrum 78 vertically downwards, with stepped bin 82 shifted lower than stepped bin 84 due to its greater distance from the fulcrum. Similarly, the counterclockwise lever 76 pivot shifts the stepped bins 74 that are right of the fulcrum 78 vertically upwards, with stepped bin 88 shifted higher than stepped bin 86 due to its greater distance from the fulcrum. The counterclockwise pivot results in the stepped bins 74 having the second stair configuration ascending in the first direction 90 opposite the second direction 96, and the top surface maintains its horizontal orientation throughout the pivot.

After the lever 76 completes its counterclockwise pivot, or at least pivots sufficiently for the top surface of a higher stepped bin 74 to be above a height of the stack 62 in the adjacent next lower stepped bin, a second sweeping operation of the automated bidirectional pusher 80 may commence. During this second sweeping operation, the bidirectional pusher 80 sweeps the stacks 62 in sequential order along the second direction 96 onto an interim stack 68 and towards a final collated stack 66 on the left-side platform 64*b*. Of course the depositing of the stacks 62 onto the stepped bins 74, the bidirectional pivoting of the lever 76, and sweeping operations of the automated bidirectional pusher 80 may continue, for example as depicted in FIGS. 5-8, to continue automatic collating and transferring of media sheets as desired.

Bidirectional collation of the media sheets 32 may be performed after each store or job requirement is completed and the bidirectional collation facilitates compiling of media sheets on the final stack platforms 64 in the shortest distance for reduced delay in feeding the media sheets to the multi-directionally stepped auto-collator system. Bidirectional collation of the media sheets 32 may also occur intra job, for example, upon a number (e.g., greater than 5, less than 100, between 10 and 50) of media sheets being deposited onto each stepped bin 74. This may occur when there are too many media sheets 32 (e.g., more than 20, more than 40, more than 200) to a store that need to be swept in the cross process directions at a time. This may also occur if a store requires media sheets 32 having different lengths, where sheets having the same length may be collated at a time before another length of sheets is deposited onto the stepped bins. Thus more than one bidirectional cross process collations may occur for a store or job requirement.

It should be noted that the collated stack 66 shown in FIG. 8 may be moved from the left-side platform 64*b* before the interim stack 68 and stacks 62 are moved to the left-side platform for further processing. Such further processing may include forwarding the collated stack 66, for example, automatically after the collated stack is placed on the platform 64*b* from the platform to a bander 44, 44*b* via a transport unit 98 (e.g., combination of at least one conveyor belt, automated pick and place device, automated arm, slide, rollers, nips, drive wheels, vacuum devices, air devices), with the bander configured to secure the collate stack together. The bander 44*b* receiving collated stacks 66 from the left-side platform 64*b* may be the same bander 44 or a different bander that receives collated stacks from the right-side platform 64*a*.

Figure 9:
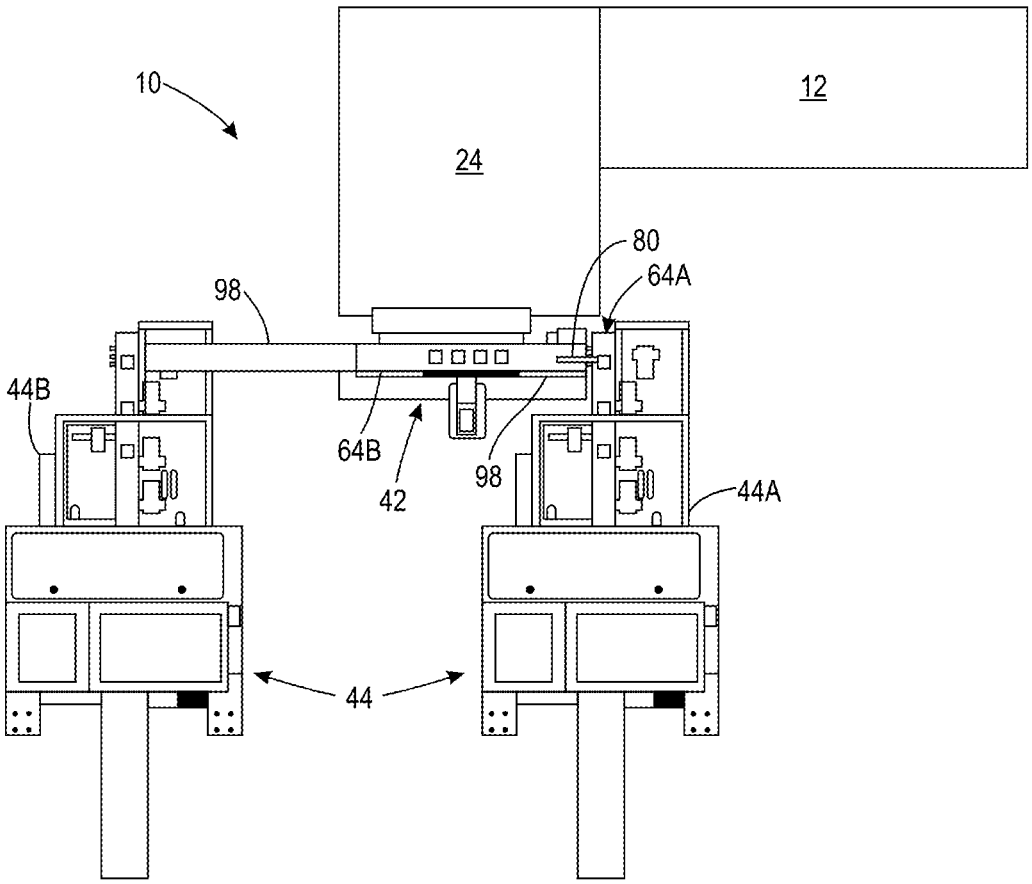
FIG. 9 is a top view of a media sheet processing system in accordance with examples of the embodiments.

In examples, the collated stacks 66 may be unloaded from the final stack platforms 64 for further processing and shipping as desired. Before such unloading, the collated stacks may be bound together for easier handling and transport. FIG. 9 depicts the system 10 including a plurality of banders 44 (e.g., Madison Bander by Controls Engineering LLC) integrated with the bidirectional collating apparatus 42 in top view. A first bander 44 (e.g., right-side bander 44*a*) may be seen adjacent the final stack platform 64, and a second bander (e.g., left-side bander 44*b*) may be offset from their respective final stack platform 64*a*, 64*b* with a transport unit 98 therebetween to move collated stacks 66 to the respective bander. The banders 44 are configured to band the collated stack 66 so that all media sheets 32 in the stack are held together in one bound package. Examples are not limited to a particular type or configuration of a specific bander. In examples, the banders 44 may wrap a thin film (e.g., plastic wrap) around a collated stack 66 automatically upon placement of the stack to the bander by the transport unit 98, as understood by a skilled artisan. In examples, the banders 44 may including a padding option, where, for example, adhesive is applied to one or more edges of a collated stack 66 to bound the stack together, as understood by a skilled artisan. The bander 44 may automatically band the compiled collated stack 66 of the media sheets 32 into a bounded bundle, for example via a sensor (e.g., camera, imager, light detector) of the bander detecting the stack (e.g., front edge, rear edge, weight, belt travel) located within the bander, and communicating the detection to the controller 16 and/or bander, as understood by a skilled artisan.

Figure 10:
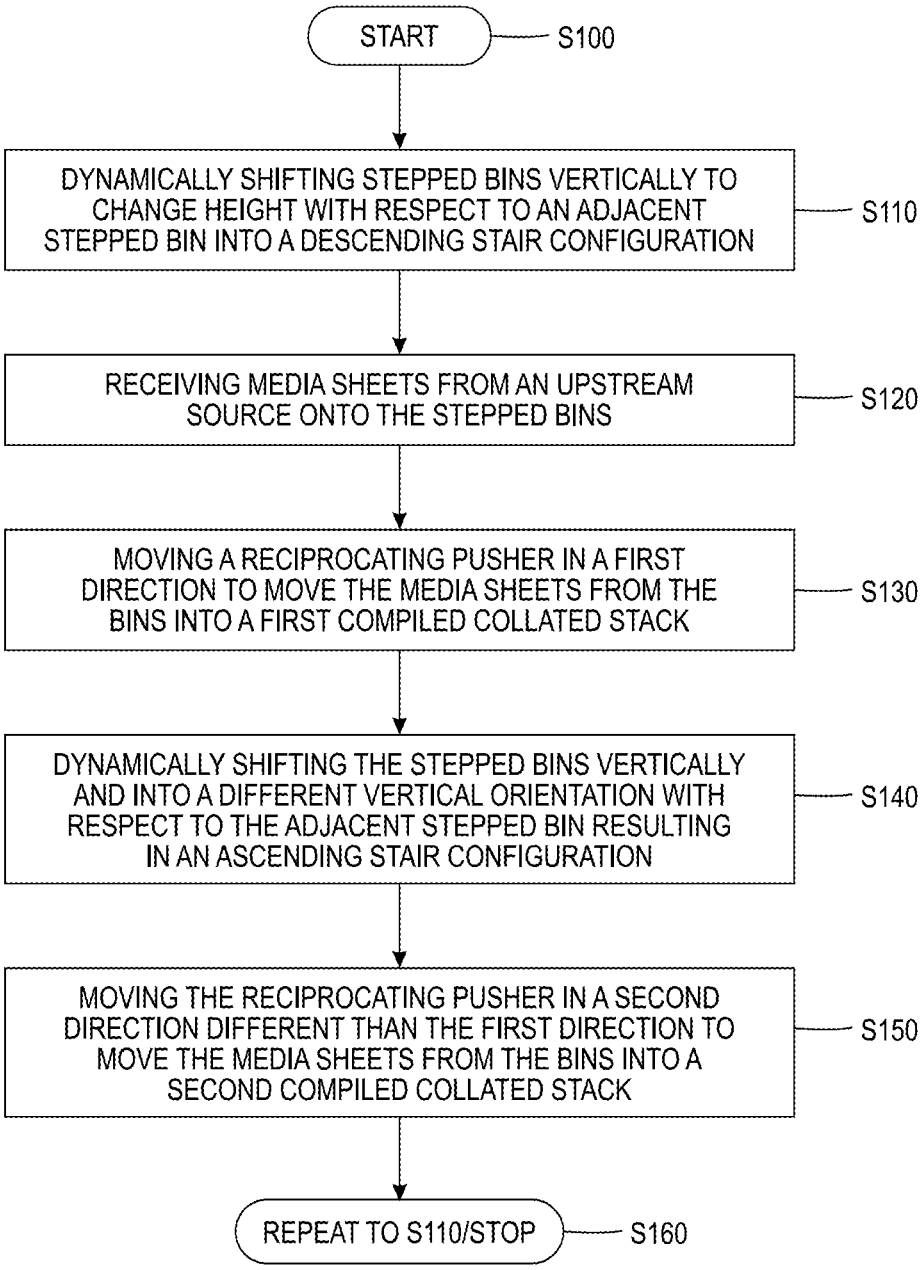
FIG. 10 is a flowchart depicting the operation of an exemplary automated media sheet processing system.

The disclosed embodiments may include an exemplary method for automated accumulation, collating, transfer and packaging of media sheets 32 and sheet stacks 62 in an automated media sheet processing system 10. FIG. 10 illustrates a flowchart of such an exemplary method. As shown in FIG. 10, operation of the method commences at Step S100 and proceeds to Step S110, where an automated media sheet processing system provides a dynamically oriented baffle having a plurality of stepped bins. Each stepped bin is slidingly arranged adjacent another one of the plurality of stepped bins and has a longitudinal surface to receive media sheets deposited thereon.

At Step S110, the system dynamically shifts the plurality of stepped bins vertically with each bin changing height with respect to an adjacent stepped bin. This dynamic shift of the stepped bins resulting in the stepped bins having a first stair configuration descending in a first direction. Operation of the method proceeds to Step S120, where the stepped bins receive a first set of the media sheets from an upstream source onto the longitudinal surfaces of the stepped bins. At Step S130, an automated reciprocating pusher configured for automatic bidirectional movement in a cross process direction to the deposited media sheets moves in a first direction to move the media sheets from the stepped bins in the first stair configuration into a first compiled collated stack at a first position. Additional media sheets may be deposited onto the stepped bins as set forth in Step 120.

Operation proceeds to Step S140, where the stepped bins are dynamically shifted vertically and into a different vertical orientation with respect to an adjacent stepped bin resulting in the plurality of stepped bins having a second stair configuration ascending in the first direction, or descending in a second direction opposite the first direction. Operation proceeds to Step S150, where the reciprocating pusher is moved in a second direction opposite the first direction to move the media sheets from the stepped bins in the second stair configuration into a second compiled collated stack at a second position distanced from the first position.

Operation may cease at Step S160 for subsequent packaging of the compiled collated stacks. In examples, subsequent packaging may include at least one banding unit adjacent the transport device that may automatically band the compiled collated stacks of the media sheets into bounded bundles. Operation may also continue by repeating back to Step S110 for a dynamic shift of the stepped bins back to the first stair configuration and processing of additional media sheets.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 10, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Figure 11:
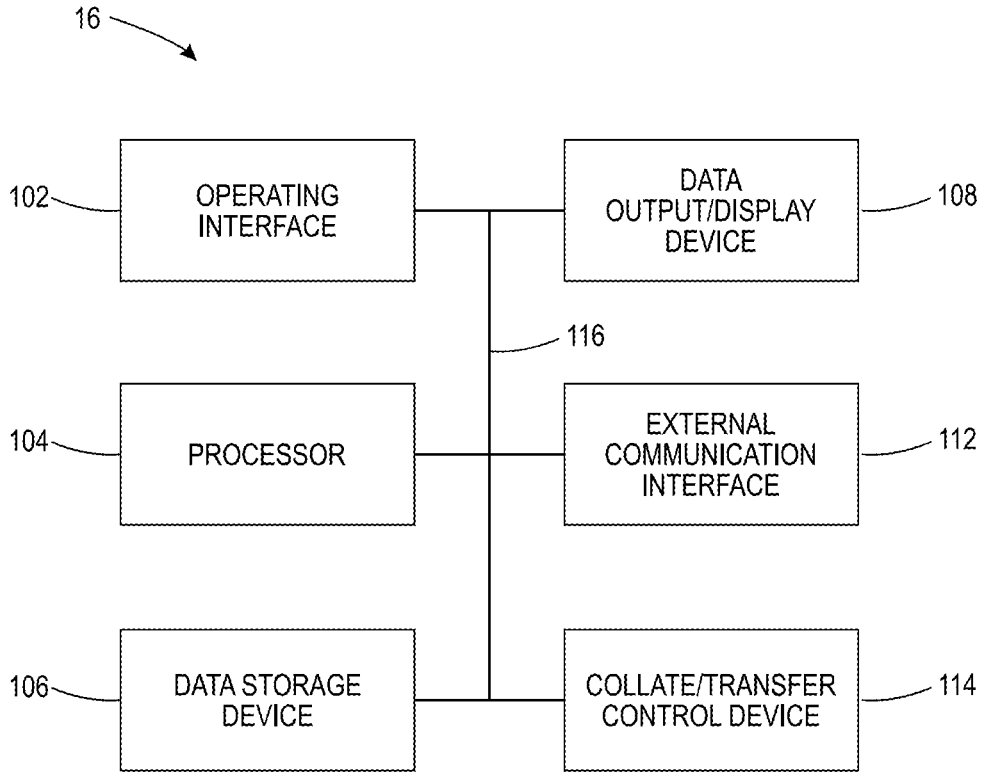
FIG. 11 is a block diagram of a controller for executing instructions to control the automated media sheet processing system.

FIG. 11 illustrates a block diagram of the controller 16 for executing instructions to automatically control the automated media sheet processing system 10 and components thereof. The exemplary controller 16 may provide input to or be a component of a controller for executing the media sheet processing method for automatically collating and transferring media sheets including controlling the media sheet accumulation, collating and transfer in a system such as that depicted in FIGS. 1, 5-9, and described in greater detail below.

The exemplary controller 16 may include an operating interface 102 by which a user may communicate with the exemplary control system. The operating interface 102 may be a locally-accessible user interface associated with the automated media sheet processing system 10. The operating interface 102 may be configured as one or more conventional mechanism common to controllers and/or computing devices that may permit a user to input information to the exemplary controller 16. The operating interface 102 may include, for example, a conventional keyboard, a touchscreen with "soft" buttons or with various components for use with a compatible stylus, a microphone by which a user may provide oral commands to the exemplary controller 16 to be "translated" by a voice recognition program, or other like device by which a user may communicate specific operating instructions to the exemplary controller. The operating interface 102 may be a part or a function of the graphical user interface (GUI) 36 mounted on, integral to, or associated with, the automated media sheet processing system 10 with which the exemplary controller 16 is associated.

The exemplary controller 16 may include one or more local processors 104 for individually operating the exemplary controller 16 and for carrying into effect control and operating functions for automated processing of media sheets 32 for distribution to associated retail stores, including accumulating the sheets onto baffles 72, collating the accumulated sheets into collated stacks 66, and/or transferring the collated stacks to platforms 64 for further processing. For example, in real-time upon receipt of media sheets 32 exiting an upstream source, processors 104 may trigger an automated bidirectional pusher 80 to shift the media sheets in collated form into a compiled collated stack 66 in store planogram order, and then move the collated stack for subsequent packaging and shipment as needed to an associated retail store. Processor(s) 104 may include at least one conventional processor or microprocessor that interprets and executes instructions to direct specific functioning of the exemplary controller 16, and control media sheet processing with the exemplary controller.

The exemplary controller 16 may include one or more data storage devices 106, including the computer storage medium 22. Such data storage device(s) 106 may be used to store data or operating programs to be used by the exemplary controller 16, and specifically the processor(s) 104. Data storage device(s) 106 may be used to store information regarding, for example, media sheet status information, media sheet accumulation information, media sheet compilation information, media sheet stack information, location information of the media sheet stacks, and other processing information with which the automated media sheet processing system 10 is associated. Stored media sheet and stack data may be devolved into data to generate a recurring, continuous or automated media sheet processing system in the manner generally described by examples herein.

The data storage device(s) 106 may include a random access memory (RAM) or another type of dynamic storage device that is capable of storing updatable database information, and for separately storing instructions for execution of media sheet processing by, for example, processor(s) 104. For example, a data storage device 106 may be coupled to the processor 104, and may include instructions which when executed by the processor, cause the processor to direct the automated bidirectional pusher 80 to move in cross process directions to the media sheets after the media sheets have settled into the dynamically stepped bins 74 to shift the media sheets in collated form from the stepped bins into a compiled collated stack at a first or second position (e.g., stack platform 64, 64*a*, 64*b*) and direct the transport unit 98 to move the compiled collated stack of media sheets from the first or second position downstream for further processing. Data storage device(s) 106 may also include a read-only memory (ROM), which may include a conventional ROM device or another type of static storage device that stores static information and instructions for processor(s) 104. Further, the data storage device(s) 106 may be integral to the exemplary controller 16, or may be provided external to, and in wired or wireless communication with, the exemplary controller 16, including as cloud-based data storage components.

The data storage device(s) 106 may include non-transitory machine-readable storage medium used to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 16 and that causes the automated media sheet processing system 10 to perform any one or more of the methodologies of the present invention. The term "machine-readable storage medium" shall accordingly be taken to include, but not be limited to, solid-state memories, and optical and magnetic media.

The exemplary controller 16 may include at least one data output/display device 108, which may be configured as one or more conventional mechanisms that output information to a user, including, but not limited to, a display screen on a GUI 36 of the automated media sheet processing system 10 device with which the exemplary controller 16 may be associated. The data output/display device 108 may be used to indicate to a user a status of the automated media sheet processing system 10 with which the exemplary controller 16 may be associated including an operation of one or more individually controlled components at one or more of a plurality of separate media sheet processing stations or subsystems associated with the automated media sheet processing system, including but not limited to the media supply 12, the buffer/compiler 58, the transport device 40, the bidirectional collating apparatus 42, the collaging system 70, the transport unit 98, and the bander(s) 44.

The exemplary controller 16 may include one or more separate external communication interfaces 112 by which the exemplary controller 16 may communicate with components that may be external to the exemplary media sheet processing system such as the media supply 12 and cutter 14. At least one of the external communication interfaces 112 may include the input/output device 20 and be configured as an input port to support connecting an external CAD/CAM device storing modeling information for execution of the control functions in the media sheet processing operations. Any suitable data connection to provide wired or wireless communication between the exemplary controller 16 and external and/or associated components is contemplated to be encompassed by the depicted external communication interface 112.

The exemplary controller 16 may include a collate/transfer control device 114 that may be used to control a media sheet processing process including media sheet accumulation, collating and transfer. The collate/transfer control device 114 may operate as a part or a function of the processor 104 coupled to one or more of the data storage devices 106 and the automated media sheet processing system 10, or may operate as a separate stand-alone component module or circuit in the exemplary controller 16.

All of the various components of the exemplary controller 16, as depicted in FIG. 11, may be connected internally, and to the automated media sheet processing system 10, associated media sheet formation and processing devices upstream or downstream the automated media sheet processing system and/or components thereof, by one or more data/control busses 116. These data/control busses 116 may provide wired or wireless communication between the various components of the automated media sheet processing system 10 and any associated media sheet formation and processing devices, whether all of those components are housed integrally in, or are otherwise external and connected to the automated media sheet processing system with which the exemplary controller 16 may be associated.

It should be appreciated that, although depicted in FIG. 11 as an integral unit, the various disclosed elements of the exemplary controller 16 may be arranged in any combination of subsystems as individual components or combinations of components, integral to a single unit, or external to, and in wired or wireless communication with the single unit of the exemplary control system. In other words, no specific configuration as an integral unit or as a support unit is to be implied by the depiction in FIG. 11. Further, although depicted as individual units for ease of understanding of the details provided in this disclosure regarding the exemplary controller 16, it should be understood that the described functions of any of the individually-depicted components, and particularly each of the depicted control devices, may be undertaken, for example, by one or more processors 104 connected to, and in communication with, one or more data storage device(s) 106.

Those skilled in the art will appreciate that other embodiments of the disclosed subject matter may be practiced with many types of media sheet processing elements common to automated media sheet processing systems in many different configurations. For example, although automated media sheet processing systems and methods are shown in the discussed embodiments, the examples may apply to other types of media sheet processing systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A system for automatically collating and transferring media sheets exiting an upstream source, comprising:

a dynamically oriented baffle having a plurality of stepped bins, each stepped bin slidingly arranged adjacent another one of the plurality of stepped bins and having a longitudinal surface to receive a first set of the media sheets deposited thereon, the dynamically oriented baffle configured to first shift the plurality of stepped bins vertically and change height with respect to an adjacent stepped bin, the first shift of the stepped bins resulting in the plurality of stepped bins having a first stair configuration descending in a first direction; and an automated reciprocating pusher configured for movement in a cross process direction to the deposited media sheets, the automated reciprocating pusher being configured during a first operation to move the first set of media sheets in the first direction from the stepped bins in the first stair configuration into a first compiled collated stack at a first position;

the dynamically oriented baffle further configured to dynamically second shift the stepped bins vertically and change vertical orientation with respect to the adjacent stepped bin, the second shift of the stepped bins resulting in the plurality of stepped bins having a second stair configuration descending in a second direction opposite the first direction, the longitudinal surfaces of the stepped bins further configured to receive a second set of the media sheets deposited thereon.

2. The system of claim 1, the automated reciprocating pusher further configured for automatic bidirectional movement in opposing cross process directions to the deposited media sheets, and during a second operation to move the second set of the media sheets in the second direction from the stepped bins in the second stair configuration into a second compiled collated stack at a second position distanced from the first position.

3. The system of claim 2, wherein the automated reciprocating pusher is further configured to move bidirectionally horizontally in the first direction and second direction absent vertical movement therebetween.

4. The system of claim 2, further comprising a transport device configured to move the first compiled collated stack of the media sheets from the first position to a third position downstream the first position in response to detecting a formation of the first compiled collated stack for subsequent packaging of the first compiled collated stack, the transport device further configured to move the second compiled collated stack of the media sheets from the second position to a fourth position downstream the second position in response to detecting a formation of the second compiled collated stack for subsequent packaging of the second compiled collated stack.

5. The system of claim 4, further comprising a first banding unit and a second banding unit, the first banding unit adjacent the transport device and configured to automatically band the first compiled collated stack of the media sheets at the third position into a bounded bundle, the second banding unit adjacent the transport device and configured to automatically band the second compiled collated stack of the media sheets at the fourth position into another bounded bundle.

6. The system of claim 2, further comprising a controller including:

a processor in communication with the dynamically oriented baffle and the automated reciprocating pusher; and a storage device coupled to the processor, wherein the storage device includes instructions which, when executed by the processor, cause the processor to direct the dynamically oriented baffle to shift the plurality of stepped bins into one of the first stair configuration and the second stair configuration, and to further cause the processor to direct the automated reciprocating pusher to move in the descending direction and move the media sheets thereon in one of the first direction and the second direction.

7. The system of claim 6, further comprising a compiler positioned along the processing path between the upstream source and the dynamically oriented baffle, the compiler being operatively connected to the controller and the dynamically oriented baffle, the compiler configured to receive the media sheets exiting the upstream source and to temporarily hold the media sheets as directed by the controller, and following one of the first operation and the second operation, the compiler further configured to release the held media sheets to the dynamically oriented baffle.

8. The system of claim 7, the compiler including a shelf configured to move from a first position where the shelf is configured to receive and hold the media sheets to a second position where the shelf is configured to release the held media sheets to the dynamically oriented baffle.

9. The system of claim 8, the shelf including a plurality of ledges, each ledge in the first position extending over a respective stepped bin.

10. The system of claim 1, further comprising a compiler positioned along the processing path between the upstream source and the dynamically oriented baffle, the compiler being operatively connected to the dynamically oriented baffle, the compiler configured to receive the media sheets exiting the upstream source and to temporarily hold the media sheets, and following the first operation, the compiler further configured to release the held media sheets to the dynamically oriented baffle.

11. The system of claim 10, the compiler including a shelf configured to move from a first position where the shelf is configured to receive and hold the media sheets to a second position where the shelf is configured to release the held media sheets to the dynamically oriented baffle.

12. The system of claim 11, the shelf including a plurality of ledges, each ledge in the first position extending over a respective stepped bin.

13. The system of claim 12, the compiler further including a plurality of guide walls each extending vertically adjacent at least one of the plurality of ledges.

14. A apparatus for automatically collating and transferring media sheets exiting an upstream source, comprising:

a dynamically oriented baffle having a plurality of stepped bins, each stepped bin slidingly arranged adjacent another one of the plurality of stepped bins and having a longitudinal surface to receive a first set of the media sheets deposited thereon, the dynamically oriented baffle configured to first shift the plurality of stepped bins vertically and change height with respect to an adjacent stepped bin, the first shift of the stepped bins resulting in the plurality of stepped bins having a first stair configuration descending in a first direction;

a compiler positioned along the processing path between the upstream source and the dynamically oriented baffle, the compiler being operatively connected to the dynamically oriented baffle, the compiler configured to receive the media sheets exiting the upstream source and to temporarily hold the media sheets, and following one of the first operation and the second operation, the compiler further configured to release the held media sheets to the dynamically oriented baffle;

an automated reciprocating pusher configured for automatic bidirectional movement in a cross process direction to the deposited media sheets, wherein, in response to detecting that the first set of the media sheets have settled into the bins for collation thereof, the automated reciprocating pusher is configured during a first operation to move the first set of the media sheets in the first direction from the stepped bins in the first stair configuration into a first compiled collated stack at a first position;

the dynamically oriented baffle further configured to dynamically second shift the stepped bins vertically and change vertical orientation with respect to the adjacent stepped bin, the second shift of the stepped bins resulting in the plurality of stepped bins having a second stair configuration descending in a second direction opposite the first direction, the longitudinal surfaces of the stepped bins further configured to receive a second set of the media sheets deposited thereon; and in response to detecting that a second set of media sheets have settled into the bins for collation thereof, the automated reciprocating pusher is further configured during a second operation to move the second set of the media sheets in the second direction from the stepped bins in the second stair configuration into a second compiled collated stack at a second position distanced from the first position, and the automated reciprocating pusher is further configured to move bidirectionally horizontally in the first direction and second direction without vertical movement therebetween.

15. A method for automatically collating and transferring media sheets exiting an upstream source, comprising:

providing a dynamically oriented baffle having a plurality of stepped bins, each stepped bin slidingly arranged adjacent another one of the plurality of stepped bins and having a longitudinal surface to receive media sheets deposited thereon, the dynamically oriented baffle configured to first shift the plurality of stepped bins vertically and change height with respect to an adjacent stepped bin, the first shift of the stepped bins resulting in the plurality of stepped bins having a first stair configuration descending in a first direction;

receiving a first set of the media sheets from the upstream source onto the longitudinal surfaces of the plurality of stepped bins;

providing an automated reciprocating pusher configured for movement in a cross process direction to the deposited media sheets;

during a first operation, moving the automated reciprocating pusher in a first direction to move the first set of the media sheets from the stepped bins in the first stair configuration into a first compiled collated stack at a first position; and dynamically shifting the stepped bins vertically and into a different vertical orientation with respect to the adjacent stepped bin resulting in the plurality of stepped bins having a second stair configuration descending in a second direction opposite the first direction, the plurality of stepped bins further configured to receive a second set of media sheets deposited thereon.

16. The method of claim 15, further comprising, during a second operation, moving the automated reciprocating pusher in a second direction opposite the first direction to move the media sheets from the stepped bins in the second stair configuration into a second compiled collated stack at a second position distanced from the first position, the automated reciprocating pusher further configured for automatic bidirectional movement in opposing cross process directions to the deposited media sheets.

17. The method of claim 16, further comprising moving the automated reciprocating pusher bidirectionally horizontally in the first direction during the first operation and in the second direction during the second operation absent vertical movement therebetween.

18. The method of claim 16, further comprising moving the first compiled collated stack of the media sheets from the first position to a third position downstream the first position with a transport device for subsequent packaging of the first compiled collated stack, and moving the second compiled collated stack of the media sheets from the second position to a fourth position downstream the second position with the transport device for subsequent packaging of the second compiled collated stack.

19. The method of claim 18, further comprising banding the first compiled collated stack of the media sheets at the third position into a bounded bundle with a first banding unit adjacent the transport device, and banding the second compiled collated stack of the media sheets at the fourth position into another bounded bundle with a second banding unit adjacent the transport device.

20. The method of claim 16, further comprising providing a compiler positioned along the processing path between the upstream source and the dynamically oriented baffle, the compiler being operatively connected to the dynamically oriented baffle, receiving receive the media sheets exiting the upstream source and temporarily holding the media sheets with the compiler, and following one of the first operation and the second operation, releasing the held media sheets to the dynamically oriented baffle via the compiler.

* * * * *